US007597312B2

(12) United States Patent
Nishioka

(10) Patent No.: US 7,597,312 B2
(45) Date of Patent: Oct. 6, 2009

(54) PAPER POST PROCESSING APPARATUS

(75) Inventor: Nobuhiro Nishioka, Osaki (JP)

(73) Assignee: Kyocera Mita Corporation, Osaka (JP)

( * ) Notice: Subject to any disclaimer, the term of this patent is extended or adjusted under 35 U.S.C. 154(b) by 399 days.

(21) Appl. No.: 11/589,152

(22) Filed: Oct. 30, 2006

(65) Prior Publication Data

US 2007/0096381 A1 May 3, 2007

(30) Foreign Application Priority Data

Oct. 31, 2005 (JP) ..... 2005-315939

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.01, 270/59, 58.07, 58.08, 58.09, 58.11, 58.12, 270/58.17, 58.27
See application file for complete search history.

(56) References Cited

U.S. PATENT DOCUMENTS

| | | | | |
|---|---|---|---|---|
| 5,842,624 | A | 12/1998 | Ishida | 227/111 |
| 6,305,681 | B1 * | 10/2001 | Watanabe et al. | 270/58.08 |
| 6,343,785 | B1 * | 2/2002 | Yamada et al. | 270/58.08 |
| 6,832,759 | B2 * | 12/2004 | Nagasako et al. | 271/222 |
| 7,090,110 | B2 * | 8/2006 | Adams et al. | 227/120 |
| 2006/0220293 | A1 * | 10/2006 | Kaneko | 270/58.08 |
| 2007/0138730 | A1 * | 6/2007 | Tsutsui et al. | 270/58.09 |

FOREIGN PATENT DOCUMENTS

| | | |
|---|---|---|
| JP | 09-086778 | 3/1997 |
| JP | 09-142724 | 6/1997 |
| JP | 10-338412 | 12/1998 |
| JP | 2002-265141 | 9/2002 |

* cited by examiner

*Primary Examiner*—Gene Crawford
*Assistant Examiner*—Leslie A Nicholson, III
(74) *Attorney, Agent, or Firm*—Smith, Gambrell & Russell, LLP

(57) ABSTRACT

A stapling unit 5 includes a stapler 10 for stapling an edge part of a stack of sheets of paper P and a carriage 11 on which the stapler 10 is mounted, and the carriage 11 is formed in such a way that it can move along a guide axis 13 that is fitted in a frame 12 in a direction (X-X' direction) perpendicular to the paper transport direction. On the carriage 11, a pair of first stoppers 16*a* and 16*b* that abut and thereby align the edge of the stack of sheets of paper P are fixed one at each side of the stapler 10 so as to be capable of shuttling in the directions indicated by arrows X and X' together with the stapler 10. Outward of the first stoppers 16*a* and 16*b*, a pair of second stoppers 17*a* and 17*b* are further provided.

14 Claims, 9 Drawing Sheets

PAPER POST PROCESSING APPARATUS

This application is based on Japanese Patent Application No. 2005-315939 filed on Oct. 31, 2005, the contents of which are hereby incorporated by reference.

BACKGROUND OF THE INVENTION

1. Field of the Invention

The present invention relates to a paper post processing apparatus that performs sorting, stapling (binding), or the like with respect to sheets of paper that have undergone an image forming process.

2. Description of Related Art

There are occasions where one wants to perform binding processing (hereinafter referred to as stapling) or hole-forming processing (hereinafter referred to as punching) with respect to a relatively large number of sheets of paper onto which images have been transferred by an image forming apparatus such as a copier or a printer. On such occasions, it is convenient to use a paper post processing apparatus, that is, a so-called finisher that automatically performs predetermined post processing such as stapling or punching.

FIG. 10 is a vertical sectional view showing an example of the structure of a conventional paper post processing apparatus. In FIG. 10, the paper post processing apparatus 1 is detachably attached to the paper ejection side of an image forming apparatus (unillustrated) such as a copier, and is provided with a processing tray 2 that accommodates a stack of a plurality of sheets of paper P. When stapling is performed with respect to sheets of paper ejected one after another out of the image forming apparatus, the stack of sheets of paper P is temporarily stored in the processing tray 2. On the upper right side of the processing tray 2, there is provided a pair of carrying-in rollers 3, so that paper ejected out of the image forming apparatus is transported into the paper post processing apparatus 1 via the carrying-in rollers 3, and is then transported onto the processing tray 2 through a carrying-in entrance 4.

Also, the processing tray 2 is provided with a stopper 9 that is movable up and down along the processing tray 2. The stopper 9 is, when sheets of paper are carried in, placed in a stand-by state at the bottom end of the processing tray 2 so that one transfer-direction edge of the stack of sheets of paper P that have been carried in one after another onto the processing tray 2 via the carrying-in rollers 3 is supported by the stopper 9. In the vicinity of the stand-by position of the stopper 9, a stapling unit 5 is provided. The stapling unit 5 performs stapling with respect to a stack of sheets of paper P that have been aligned at one transfer-direction edge by the stopper 9. The stack of sheets of paper P that has undergone stapling is transported by the stopper 9 along the processing tray 2 to the upper portion of the paper post processing apparatus 1 to be ejected via stack ejection rollers 6 onto an ejection tray 7.

With regard to the paper post processing apparatuses structured as described above, various types have been proposed and commercialized that are capable of stapling a stack of sheets of paper P at two or more positions by moving the stapling unit 5 in directions substantially perpendicular to the transport direction of the stack of sheets of paper P (that is, in FIG. 10, in directions perpendicular to the plane of the figure). For example, JP-A-H10-338412 discloses a sheet processing apparatus that is provided with: a stapling unit arranged inside the main body of the apparatus; a stapler tray onto which sheets of paper with respect to which stapling is to be performed are temporarily carried to be stacked one on top of another; and a plurality of stopper members that determine where to stop the sheets of paper. Here, each stopper member is permitted to move independently between a stop position where it remains engaged with sheets of paper stacked on the tray and a retracted position where it remains away from the sheets of paper.

In JP-A-H9-142724, a paper post processing apparatus is disclosed that is provided with two stoppers for aligning an edge of sheets of paper, one disposed in a front side of and the other in a rear side of the bottom of a stapler tray, each stopper having a cutout window through which part of the surface of sheets of paper at which they are to be stapled is exposed, and furthermore, the cutout window of the stopper disposed at the rear part of the stapler tray is so shaped that the stopper does not interfere with a stapler when diagonal stapling is performed.

In JP-A-H9-86778, a stapling unit is disclosed that is provided with an angle changing mechanism that changes the angle at which diagonal stapling is performed by rotating a stapler around a rotation axis located in the vicinity of the stapling portion of the stapler and forward/backward moving means that moves the body of the stapler forward/backward between a stapling position in which it staples sheets of paper and a retracted position into which the stapler is retracted away from sheets of paper. Here, the angle and the position at which diagonal stapling is performed with respect to sheets of paper are freely adjustable, with as small a part as possible of the mechanism protruding out of the sheet corner.

However, in any of the apparatuses disclosed in JP-A-H10-338412, JP-A-H9-142724, and JP-A-H9-86778, since the stapler body and the stoppers are built as separate units, it is difficult, when the stapler or the stoppers is moved, to maintain an accurate positional relationship among them, and this tends to cause variation in the distance of a staple position from the edge of a paper stack, which is inconvenient. Also, drive means for moving the stoppers needs to be prepared separately, and this makes the apparatuses not only complexed in structure but also disadvantageous in cost.

SUMMARY OF THE INVENTION

In view of the above described inconveniences, an object of the present invention is to provide a paper post processing apparatus that can perform stapling at two or more positions and that can do it, despite having a simple structure, with higher accuracy in terms of the stapling position from an edge of paper.

To achieve the above object, according to the present invention, a paper post processing apparatus is provided with: a processing tray that accommodates a plurality of sheets of paper; stapling means that performs edge stapling with respect to a paper stack on the processing tray; a stapling unit on which the stapling means is mounted and that moves in a direction perpendicular to a paper transport direction; and a pair of first stoppers that are fixed one at each side of the stapling means on the stapling unit and that jog and thereby align a paper-transport-direction edge of paper.

With this structure, the positional relationship among the first stoppers and the stapling means does not vary with the movement of the stapling unit, and this makes it easy to maintain an accurate positional relationship among them, and this reduces variation in the distance of a stapling position from the edge of a paper stack. Furthermore, the first stoppers move together with the stapling unit, and this eliminates the need to separately prepare drive means for moving the first stoppers.

According to the present invention, in the paper post processing apparatus structured as described above, the stapling means is supported on the stapling unit so as to be rotatable around a rotation axis positioned in a vicinity of a stapling position, and one of the first stoppers that is positioned in a direction in which the stapling means rotates is designed to rotate together with the stapling means.

With this structure, the stapling means is arranged so as to be rotatable on the stapling unit around the rotation axis positioned in the vicinity of the stapling portion, and the one of the first stoppers that is positioned in the direction in which the stapling means rotates together with the stapling means, and this prevents the one of the first stoppers positioned in the direction in which the stapling means rotates from interfering with the rotation of the stapling means.

According to the present invention, in the paper post processing apparatus structured as described above, the first stoppers are, when stapling is performed at two positions in an edge part of a paper stack, positioned inward of a minimum-size paper width.

With this structure, when stapling processing is performed at two positions, regardless of the size of paper, by using the first stoppers, the distance of the stapling positions from the edge of a paper stack can be set with enhanced accuracy.

According to the present invention, in the paper post processing apparatus structured as described above, outward of the first stoppers, there is provided a pair of second stoppers that move, independently of each other, between a first position where the second stoppers can align an edge of minimum-size paper and a second position that is located outward of a maximum-size paper width.

With this structure, proper combinations of the first and second stoppers make it possible to align the edges of stacks of sheets of paper of two or more sizes, and thereby to set the distance of the stapling position from the edge of a paper stack with enhanced accuracy regardless of the size of paper. Furthermore, there is no need to provide drive means for moving the second stoppers, and this makes the structure of the paper post processing apparatus simple.

According to the present invention, in the paper post processing apparatus, elastically biasing means is provided for elastically biasing and thereby keeping the second stoppers in the first position.

With this structure, the pressing force caused by the movement of the stapling unit and the elastically biasing force of the elastically biasing means permit the second stoppers to move with a simple mechanism.

According to the present invention, in the paper post processing apparatus structured as described above, the second stoppers, when moving to the second position, retract to a downstream side in the paper transport direction with respect to an edge of a paper stack.

With this structure, when the second stoppers move, they are prevented from interfering with the edge of the paper stack, and this permits the second stoppers to move smoothly and also permits the paper stack to be kept aligned, and hence the stapling means can perform stapling with enhanced accuracy.

According to the present invention, in the paper post processing apparatus structured as described above, at an end of each of the second stoppers, a paper receiving portion is formed for aligning an edge of a paper stack, the second stoppers are supported so as to be slidable in a direction perpendicular to a paper transport direction along a guide axis fixed to a frame inside a main body of the apparatus and are also supported so as to be swingable around the guide axis with respect to an edge of a paper stack, and on the frame is formed a groove to which another end of each of the second stoppers is slidably engaged and that, with movement of the second stoppers from the first position to the second position, permits the paper receiving portions to retract to the downstream side in the paper transport direction with respect to an edge of a paper stack.

With this structure, with the movement of the second stoppers from the first position to the second position, the paper receiving portions of the second stoppers can be retracted from the edge of the stack of sheets of paper with a simple mechanism.

DETAILED DESCRIPTION OF PREFERRED EMBODIMENTS

Figure 1:
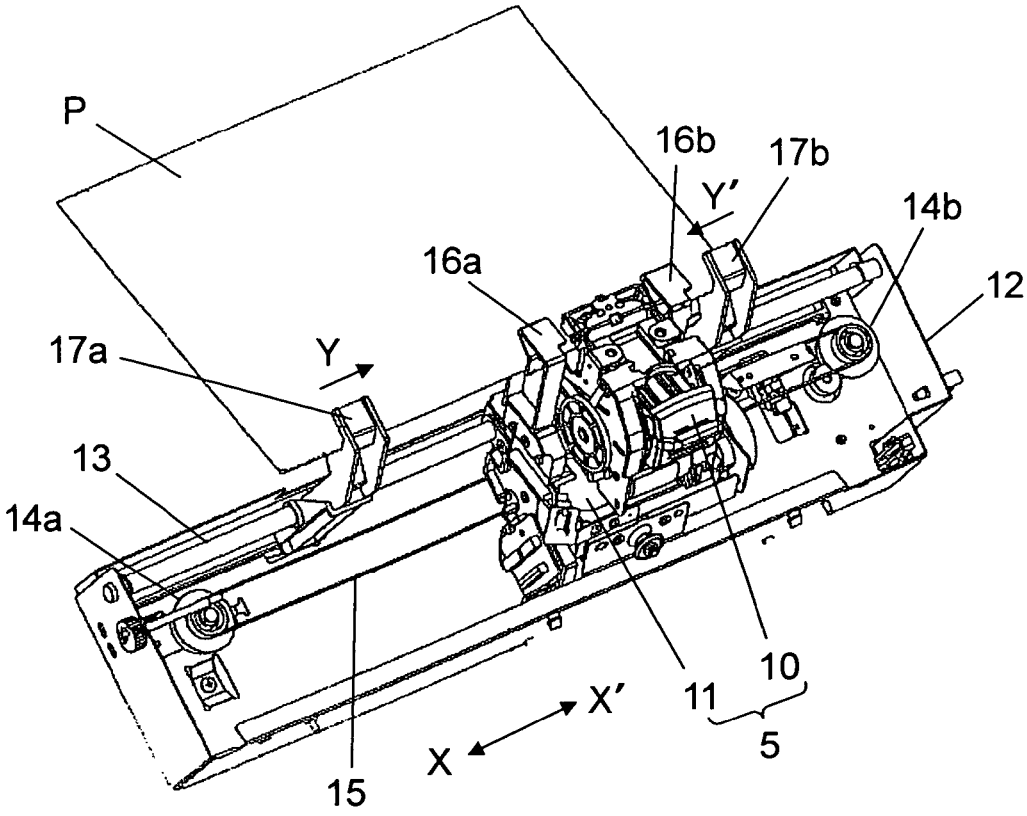
FIG. 1 is a perspective view showing the structure of the vicinity of a stapling unit of a paper post processing apparatus of a first embodiment.
Figure 10:
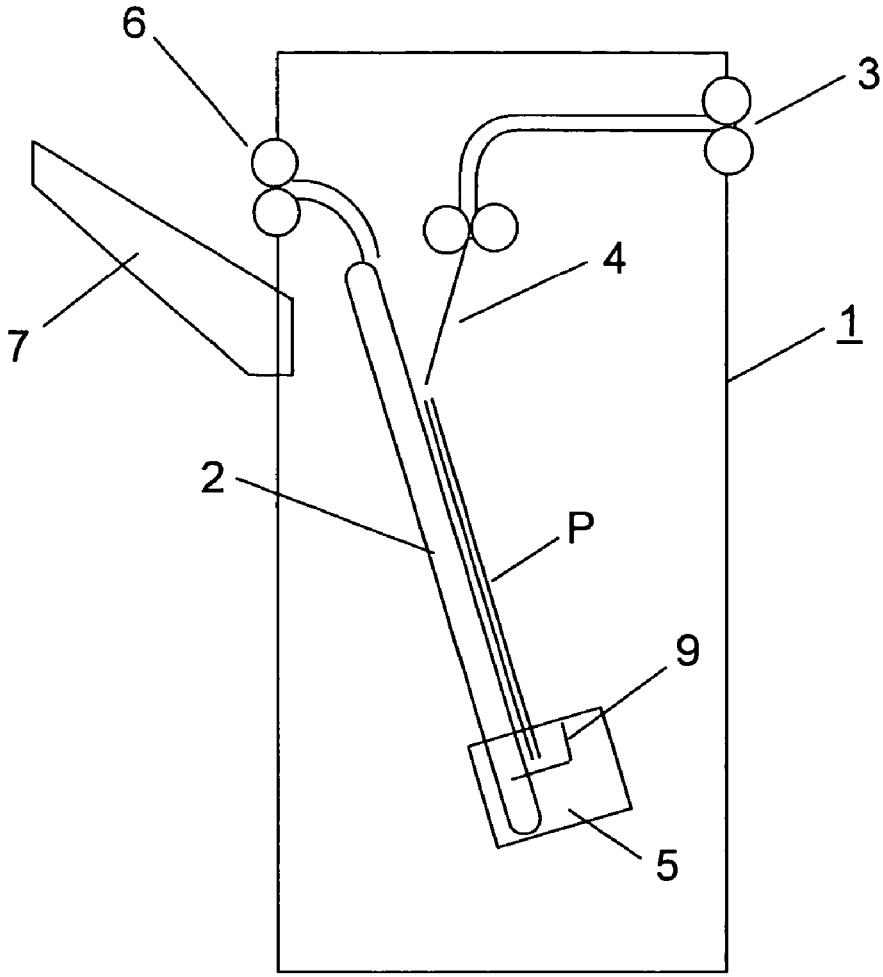
FIG. 10 is a vertical sectional view showing the whole structure of a conventional paper post processing apparatus.

Hereinafter, embodiments of the present invention will be described with reference to the accompanying drawings. FIG. 1 is a perspective view showing the structure of the vicinity of the stapling unit of the paper post processing apparatus of a first embodiment. As shown in FIG. 1, a stapling unit 5 is so structured as to include a stapler 10 for performing stapling with respect to an edge of a stack of sheets of paper P stacked one on top of another in a processing tray 2 (see FIG. 10) and a carriage 11 on which the stapler 10 is mounted, and the carriage 11 is so formed as to be capable of shuttling along a guide axis 13 fitted in a frame 12 in directions (the directions indicated by arrows X-X' in the figure) perpendicular to the paper transport direction. The carriage 11 is moved by driving a carriage motor (unillustrated) to rotate an endless belt 15 wound around and between pulleys 14*a* and 14*b* that transmit the driving power of the carriage motor to the endless belt 15.

On the carriage 11, a pair of first stoppers 16*a* and 16*b* that abut and thereby align an edge of a stack of sheets of paper P are fixed at both sides of the stapler 10 and they can move in the directions indicated by arrows X and X' together with the stapler 10. Outward of the first stoppers 16*a* and 16*b*, a pair of second stoppers 17*a* and 17*b* are further provided.

The second stoppers 17*a* and 17*b* are each elastically biased inward (in the directions indicated by arrows Y and Y') by an unillustrated tension spring (elastically biasing means), and as shown in FIG. 1, when the stapling unit 5 is positioned inward of the width of paper, the second stoppers 17*a* and 17*b* are positioned at home positions thereof (hereinafter referred to as the first position) where they can align the edge of a stack of sheets of paper of a minimum width. The second stoppers 17*a* and 17*b* are so arranged as to be, when they are positioned in the first position, at the same height as the first stoppers 16*a* and 16*b* from the edge of the stack of sheets of paper P.

Figure 2:
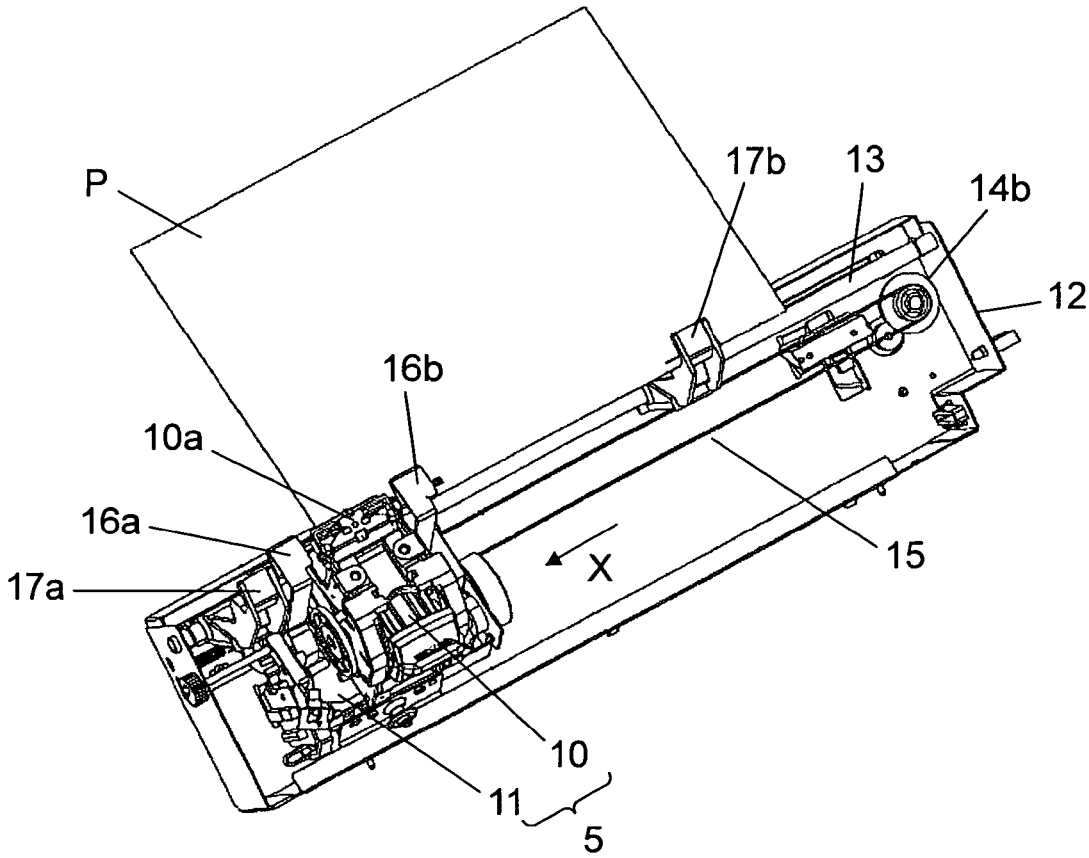
FIG. 2 is a perspective view showing the positional relationship among a stapler, first stoppers, and second stoppers when one-front-position stapling is performed by using the paper post processing apparatus of the first embodiment.

Next will be described how the stapler, the first stoppers, and the second stoppers behave when stapling is performed with respect to the edge of a stack of sheets of paper by using the paper post processing apparatus of the present invention. FIG. 2 is a perspective view showing the positional relationship among the stapler, the first stoppers, and the second stoppers when stapling is performed at one front position of the edge of the stack of sheets of paper (hereinafter referred to as one-front-position stapling) by using the paper post processing apparatus of the first embodiment. For ease of description, the processing tray 2 is not illustrated, and the stack of sheets of paper P is of the maximum permissible size with respect to which the stapling unit 5 can perform stapling (here, A4 lateral size).

In the case of one-front-position stapling, as shown in FIG. 2, first the endless belt 15 is driven to move the stapling unit 5 a predetermined amount in the direction indicated by arrow X until a stapling portion of the stapler 10 meets the front side end (left-hand side end in the figure) of the edge of the stack of sheets of paper P. At this time, the front-side second stopper 17*a* is pushed out in the direction indicated by arrow X by the stapling unit 5 against the elastically biasing force of the elastically biasing means (unillustrated) so as to be positioned outside the paper width (hereinafter referred to as the second position) together with the first stopper 16*a*.

On the other hand, the rear-side second stopper 17*b* is positioned in the first position, and hence the edge of the stack of paper P is aligned by the second stopper 17*b* and the first stopper 16*b*. In this way, at the two positions, by the second stopper 17*b* and the first stopper 16*b*, positioning of the stack of sheets of paper P can surely be performed. Also, the positional relationship between the first stopper 16*b* and the stapler 10 does not vary with the movement of the stapling unit 5, and this makes it easy to maintain an accurate positional relationship between the first stopper 16*b* and the stapler 10, and consequently variation in the distance of a stapling position from the edge of the stack of sheets of paper P can be reduced.

Figure 3:
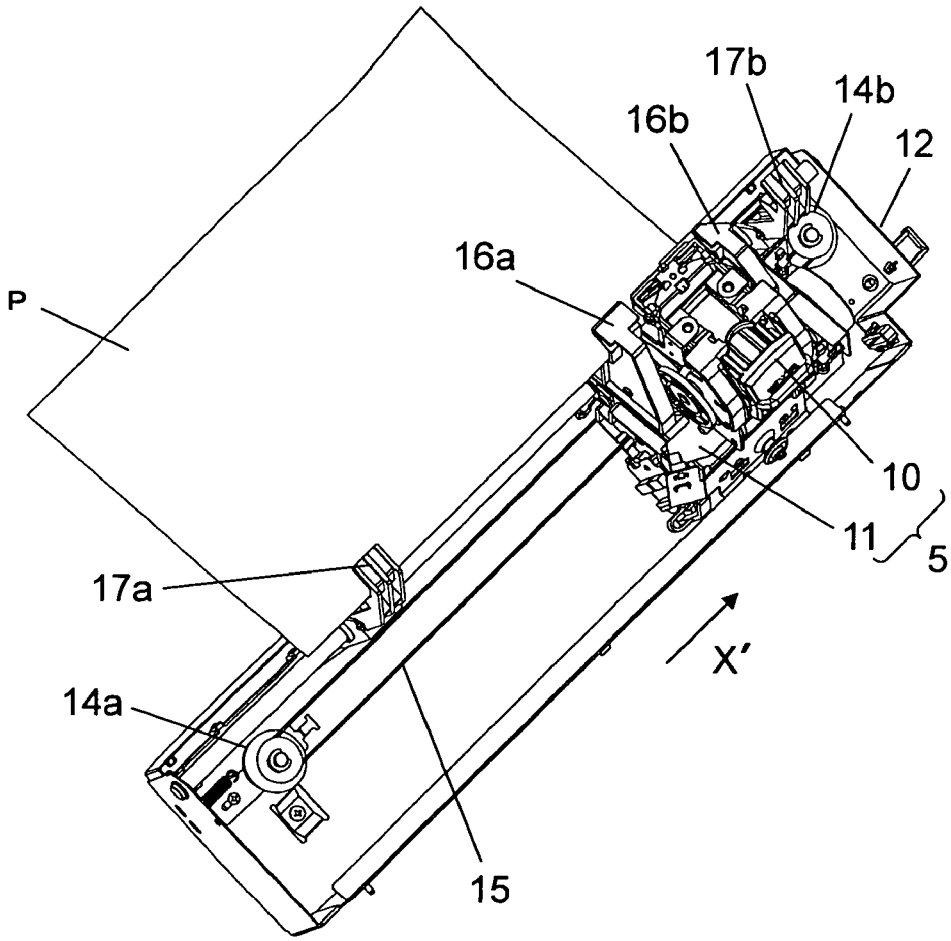
FIG. 3 is a perspective view showing the positional relationship among the stapler, the first stoppers, and the second stoppers when one-rear-position stapling is performed by using the paper post processing apparatus of the first embodiment.

FIG. 3 is a perspective view showing the positional relationship among the stapler, the first stoppers, and the second stoppers when stapling is performed at one rear position of the edge of the stack of sheets of paper (hereinafter referred to as one-rear-position stapling) by using the paper post processing apparatus of the first embodiment. In the case of one-rear-position stapling, as shown in FIG. 3, first the endless belt 15 is driven to move the stapling unit 5 a predetermined amount in the direction indicated by arrow X' until it meets the rear side end (right-hand side end in the figure) of the edge of the stack of sheets of paper P. At this time, the rear-side second stopper 17*b* is pushed out in the direction indicated by arrow X' by the stapling unit 5 against the elastically biasing force of the elastically biasing means (unillustrated) so as to be positioned in the second position together with the first stopper 16*b*.

On the other hand, the front-side second stopper 17*a* is positioned in the first position, and hence the edge of the stack of sheets of paper P is aligned by the second stopper 17*a* and the first stopper 16*a*. In this way, as in the case of one-front-position stapling, at the two positions, by the second stopper 17*a* and the first stopper 16*a*, positioning of the edge of the stack of sheets of paper P can surely be performed, and this reduces variation in the distance of a stapling position from the edge of the stack of sheets of paper P.

Figure 4:
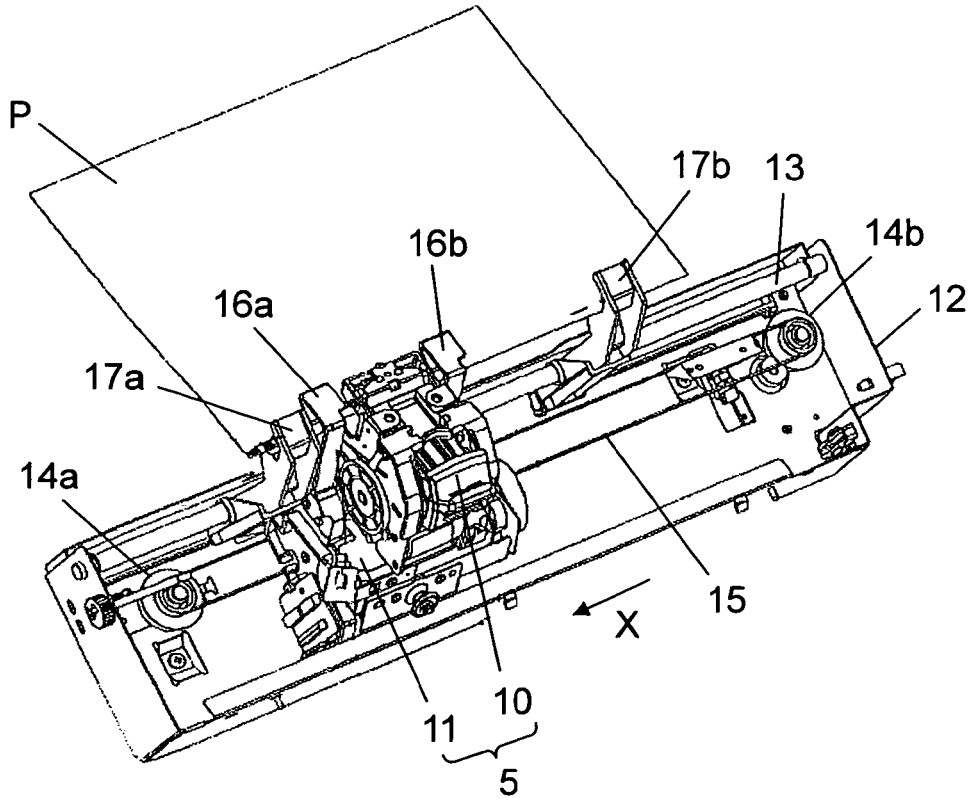
FIG. 4 is a perspective view showing the positional relationship among the stapler, the first stoppers, and the second stoppers when two-position front stapling is performed by using the paper post processing apparatus of the first embodiment.

Next, two-position stapling will be described in which stapling is performed at two positions of the edge of a stack of sheets of paper. FIG. 4 is a perspective view showing the positional relationship among the stapler, the first stoppers, and the second stoppers when stapling is performed at a front position of the edge of the stack of sheets of paper in two-position stapling (hereinafter referred to as two-position front stapling) by using the paper post processing apparatus of the first embodiment, and FIG. 5 is a perspective view showing the positional relationship among the stapler, the first stoppers, and the second stoppers when stapling is performed at a rear position of the edge of the stack of sheets of paper in two-position stapling (hereinafter referred to as two-position rear stapling).

In the case of two-position front stapling, as shown in FIG. 4, the endless belt 15 is driven to move the stapling unit 5 a predetermined distance in the direction indicated by arrow X until it comes to a predetermined position at the front side (left-hand side in the figure) of the edge of the stack of sheets of paper P. At this time, since the stapling unit 5 moves less in the direction indicated by arrow X than in the case of one-front-position stapling, although the front-side second stopper 17*a* is pushed out to the second position against the elastically biasing force of the elastically biasing means (unillustrated), the first stopper 16*a* remains inward of the paper width. Hence, the edge of the stack of sheets of paper P is aligned at the three positions by the second stopper 17*b* and the first stoppers 16*a* and 16*b*.

Figure 5:
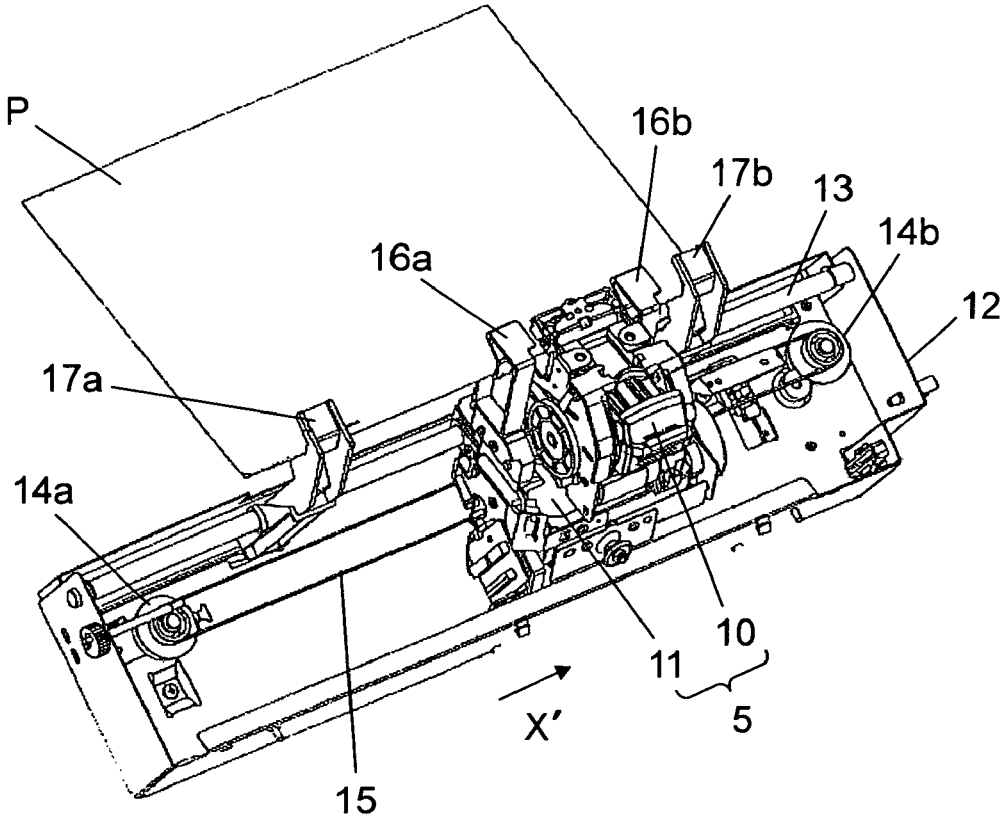
FIG. 5 is a perspective view showing the positional relationship among the stapler, the first stoppers, and the second stoppers when two-position rear stapling is performed by using the paper post processing apparatus of the first embodiment.

When two-position front stapling has been finished, as shown in FIG. 5, the endless belt 15 is driven reversely to move the stapling unit 5 a predetermined amount in the direction indicated by arrow X' so that the stapling portion of the stapler 10 comes to a predetermined position at the rear side (right-hand side in the figure) of the stack of sheets of paper P. At this time, since the stapling unit 5 moves less in the direction indicated by arrow X' than in the case of one-rear-position stapling, although the rear-side second stopper 17*b* is pushed out to the second position against the elastically biasing force of the elastically biasing means (unillustrated), the first stopper 16*b* remains inward of the paper width. Hence, the edge of the stack of sheets of paper P is aligned at the three positions by the second stopper 17*a* and the first stoppers 16*a* and 16*b*.

Accordingly, in two-position stapling, as in the cases of one-front-position stapling and one-rear-position stapling, positioning of the stack of sheets of paper P can surely be performed. Also, the positional relationship among the first stoppers 16*a* and 16*b* and the stapler 10 does not vary with the movement of the stapling unit 5, and this makes it easy to maintain an accurate positional relationship among the stapler 10 and the first stoppers 16*a* and 16*b*, and consequently variation in the distance of a stapling position from the edge of the stack of sheets of paper P can be reduced.

Figure 6:
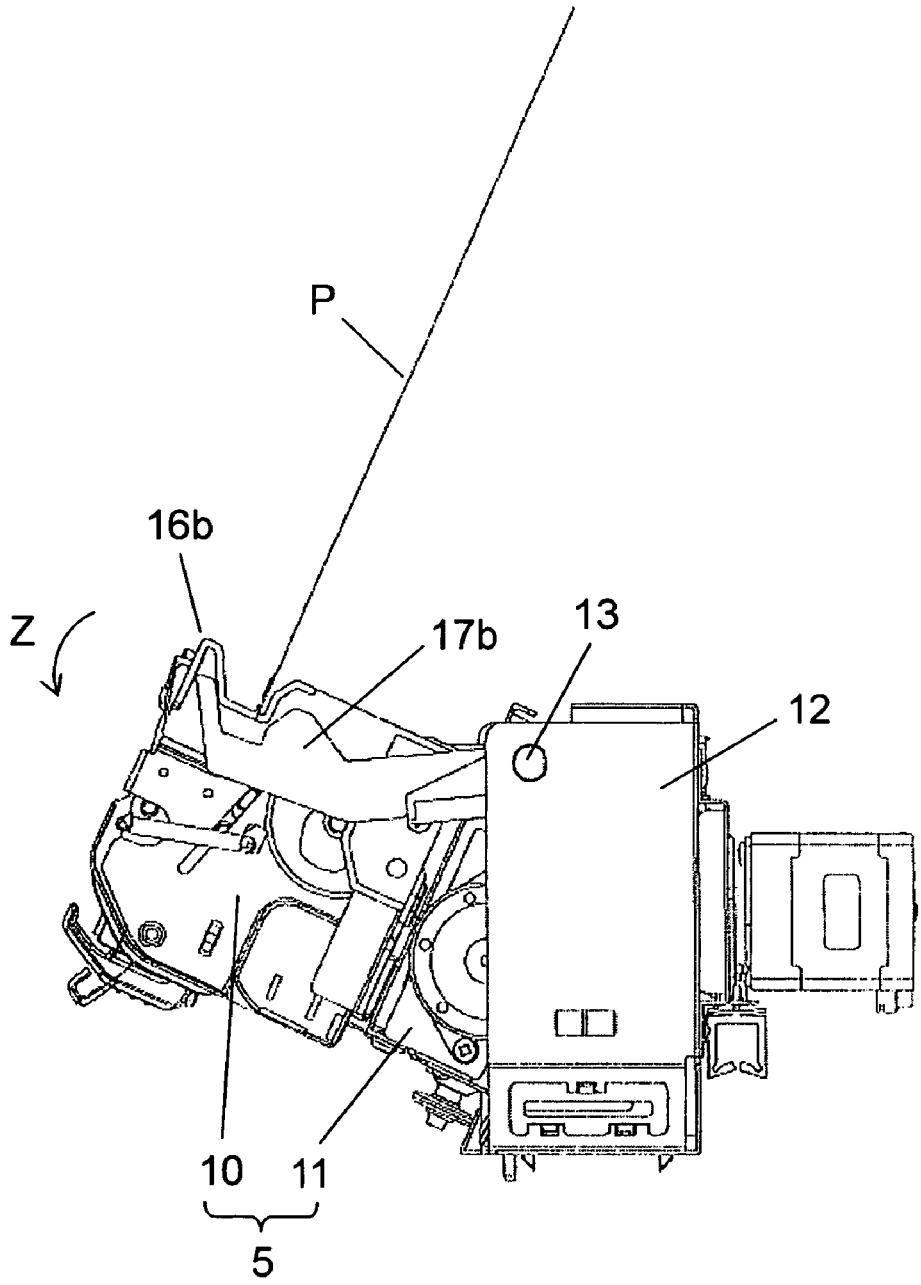
FIG. 6 is a side view showing the stapling unit in the state in which one of the second stoppers has been retracted from the edge of the stack of sheet of paper.

Also, when stapling proceeds from two-position front stapling to two-position rear stapling, the second stopper 17*b* is pushed out to the second position, and at this time, as shown in FIG. 6, the second stopper 17*b*, when it moves from the first position to the second position, retracts in the direction perpendicular to the edge of the stack of sheets of paper P (the direction indicated by arrow Z). This reduces the interference between the edge of the stack of paper P and the second stopper 17*b*, and thereby prevents the stack of sheets of paper P from becoming misaligned.

Figure 7A:
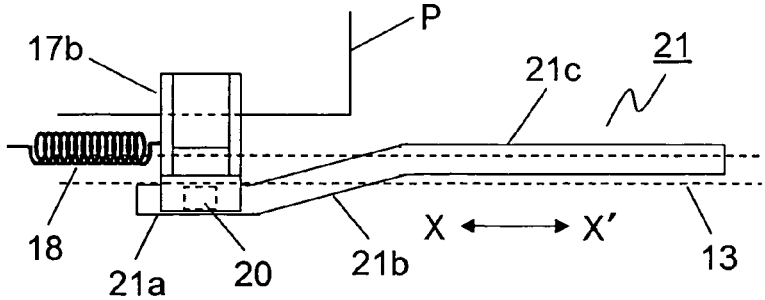
FIG. 7A and 7B are a front view and a right-hand side view, respectively, showing the second stopper 17*b* when it is in the first position.
Figure 7B:
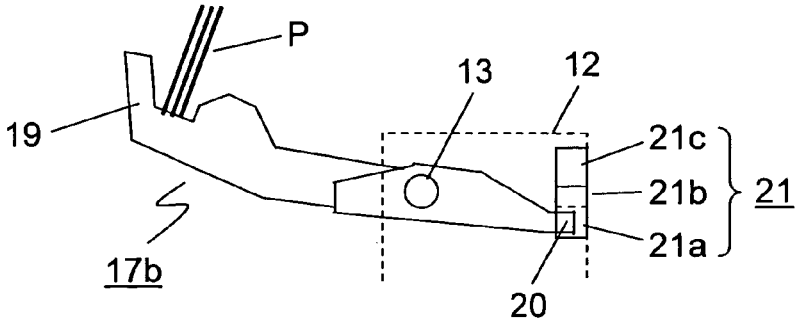

The mechanism by which the second stopper 17*b* is retracted will now be described with reference to FIGS. 7A, 7B, 8A, and 8B. FIGS. 7A and 7B are a front view and a right-hand side view, respectively, showing the second stopper 17*b* positioned in the first position. For ease of description, the first stopper 16*b* and the stapler 10 are not illustrated in the figures. The second stopper 17*b* is supported in such a way as to laterally slide freely along and to move up and down around the guide axis 13, and is elastically biased by the elastically biasing force of the tension spring 18 in the left-hand direction in FIG. 7A.

At one end of the second stopper 17*b*, a paper receiving portion 19 is formed, and at the end opposite to the end where the paper receiving portion 19 is formed, a boss 20 is formed. Inside the frame 12, a groove 21 is formed that is composed of a lower step part 21*a*, a slope part 21*b*, and an upper step part 21*c*. The boss 20 engages with the groove 21, and the groove 21 guides the second stopper 17*b* so that the second stopper 17*b* moves between the first position and the second position. Accordingly, the moving range of the second stopper 17*b* is determined by the length of the groove 21. As shown in FIGS. 7A and 7B, when the second stopper 17*b* is in the first position, the boss 20 is kept engaged with the lower step part 21*a*, and hence the second stopper 17*b* can align the edge of the stack of sheets of paper P.

Figure 8A:
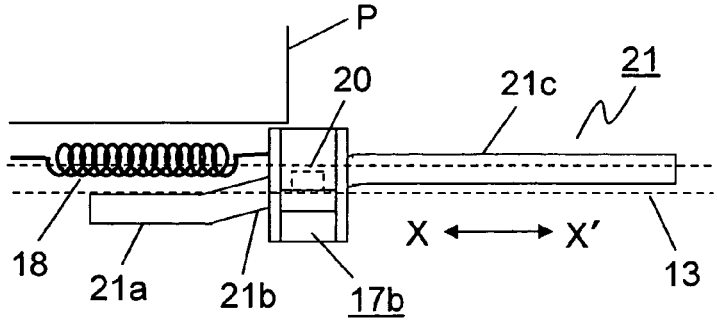
FIG. 8A and 8B are a front view and a right-hand side view, respectively, illustrating how the second stopper 17*b* moves from the first position to the second position.
Figure 8B:
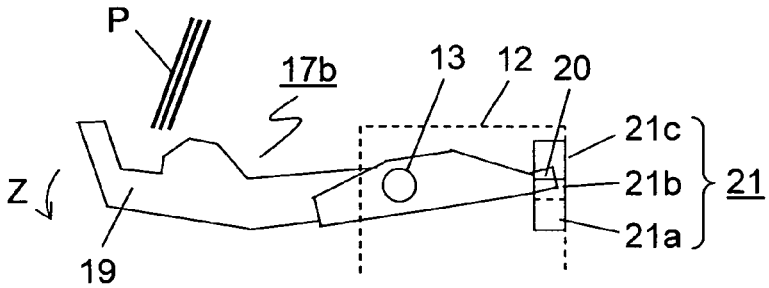

Now, if the stapling unit 5 (see FIG. 6) moves to push the second stopper 17*b* in the direction indicated by arrow X', the second stopper 17*b*, as shown in FIGS. 8A and 8B, slides in the right-hand direction along the guide axis 13 against the elastically biasing force of the tension spring 18. At this time, the boss 20 slides in the groove 21; from the lower step part 21*a*, via the slope part 21*b*, to the upper step part 21*c*. Accordingly, the paper receiving portion 19 moves in the direction that is opposite to the direction in which the boss 20 moves, that is, in the direction indicated by arrow Z and retracts from the edge of the stack of sheets of paper P.

And when the stapling unit 5 moves back to the original position thereof, the second stopper 17*b* is pulled back by the elastically biasing force of the tension spring 18 in the direction indicated by arrow X, and the boss 20 slides in the groove 21 from the upper step part 21*c*, via the slope part 21*b*, to the lower step part 21*a*, and consequently the paper receiving portion 19 comes back to the first position where it can align the edge of the stack of sheets of paper P.

With this structure, when the second stoppers 17*a* and 17*b* move, they are prevented from interfering with an edge of a stack of sheets of paper P, and this permits the second stoppers 17*a* and 17*b* to move smoothly and also permits the stack of sheets of paper P to be kept aligned, and hence the stapler 10 can perform stapling with enhanced accuracy. Incidentally, it is preferable that the second stoppers 17*a* and 17*b* be capable of supporting the edge of a stack of sheets of paper P when they are positioned inward of the width of the paper of the maximum permissible size, and hence the groove 21 should be so shaped as to permit the second stopper 17*b* to retract from the edge of a stack of sheets of paper P at the time when it has moved outward the width of the paper of a maximum size, that is, when it has moved to the second position.

The retraction mechanism of the rear-side second stopper 17*b* has hitherto been described, and the retraction mechanism of the front-side second stopper 17*a* can be described in a similar fashion. Also, it should be understood that the second stoppers 17*a* and 17*b* retract from the edge of a stack of sheets of paper P when they move to the second position in one-front-position stapling and in one-rear-position stapling as shown in FIGS. 2 and 3.

Figure 9:
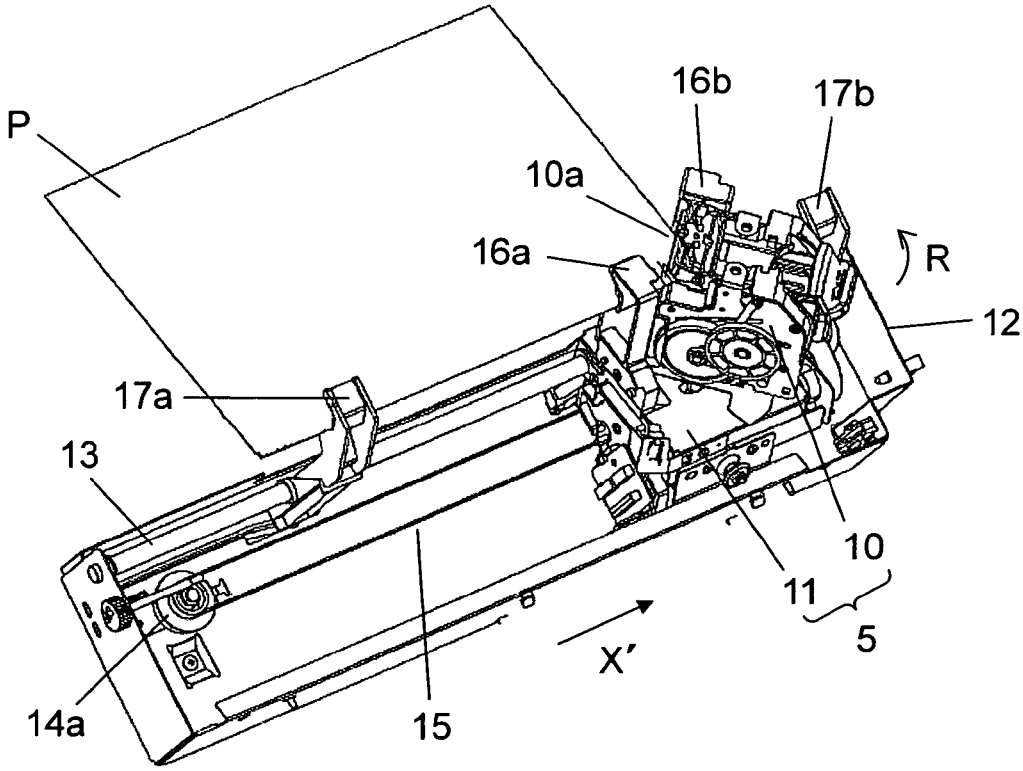
FIG. 9 is a perspective view showing the positional relationship among the stapler, the first stoppers, and the second stoppers when diagonal-one-rear-position stapling is performed by using the paper post processing apparatus of a second embodiment.

FIG. 9 is a perspective view showing the structure of the vicinity of the stapling unit of the paper post processing apparatus of a second embodiment of the present invention. Such parts as are found also in FIG. 1, which illustrates the first embodiment, are identified with common reference numerals and symbols, and overlapping description will not be repeated. In this embodiment, the stapler 10 is rotatably supported on the carriage 11 with the rotation axis thereof positioned in the vicinity of the stapling portion, and hence diagonal stapling can be performed. Also, the front-side first stopper 16*a* is fixed to the carriage 11, and the rear-side first stopper 16*b* is fixed to the body of the stapler 10.

Next, a case will be described in which diagonal stapling is performed at one rear position of paper (hereinafter referred to as diagonal-one-rear-position stapling) by using the paper post processing apparatus of the second embodiment. Here, as in the case of one-rear-position stapling shown in FIG. 3, the stapling unit 5 is moved a predetermined amount in the direction indicated by arrow X' until it meets the rear side end (right-hand side end in the figure) of the edge of the stack of sheets of paper P. Thereafter, by a stapler rotation motor (unillustrated), the stapler 10 is rotated a predetermined angular amount in the direction indicated by arrow R. At this time, the first stopper 16*b* is fixed to the body of the stapler 10 and hence rotates with the body of the stapler 10 in the direction indicated by arrow R.

With this structure, as in the first embodiment, by using the first stoppers 16*a* and 16*b* that are fixed to the stapling unit 5, in both cases of one-position stapling and two-position stapling, it is possible to reduce variation in the distance of a stapling position from the edge of the stack of sheets of paper P. Also, the stapler 10, which is formed to be rotatable, permits diagonal stapling to be performed, and furthermore, since the first stopper disposed in the rotation direction of the stapler 10 is fixed to the body of the stapler 10, it does not disturb the rotation of the stapler 10.

Incidentally, diagonal-one-rear-position stapling has hitherto been described, and diagonal-one-front-position stapling in which diagonal stapling is performed at one front-side position of paper can be described in a similar fashion. In diagonal-one-front-position stapling, the front-side first stopper 16*a* disposed in the rotation direction of the stapler 10 should be fixed to the body of the stapler 10. Furthermore, by fixing both of the first stoppers 16*a* and 16*b* to the body of the stapler 10, a paper post processing apparatus capable of performing both diagonal-one-front-position stapling and diagonal-one-rear-position stapling can be realized.

It should be understood that the present invention may be carried out in any manner other than specifically described above as embodiments, and many modifications and variations are possible within the scope and spirit of the present invention. For example, in the above embodiments, the second stoppers 17*a* and 17*b* are each provided with a retraction mechanism for retracting from the edge of a stack of sheets of paper, but they may be structured otherwise. Also, the description hitherto deals with cases in which stapling is performed with respect to a stack of sheets of paper P of one particular size (A4 lateral size), but the present invention can be applied to cases in which, by controlling the stop position of the stapling unit according to the paper size, stapling is performed with respect to two or more sizes of paper.

Also, in the above embodiments, the elastically biasing force of the tension spring 18 and the pressing force of the stapling unit 5 are used to move the second stoppers 17*a* and 17*b*, but this does not limit moving means for moving the second stoppers 17*a* and 17*b* in any way, and they may be designed to move together with the stapling unit by using, for example, magnetic power.

According to the present invention, the positional relationship among the first stoppers and the stapling means does not vary with the movement of the stapling unit, and this makes it easy to maintain an accurate positional relationship among the stapling means and the first stoppers, and consequently variation in the distance of a stapling position from the edge of a stack of sheets of paper can be reduced, and this makes it possible to provide a paper post processing apparatus capable of performing stapling with enhanced accuracy. Also, since the first stoppers move together with the stapling unit, there is no need to separately prepare drive means for moving the first stoppers, and this contributes to reducing the number of components and thereby to simplifying the structure of the paper post processing apparatus.

Also, in the structure in which the stapling means rotates on the stapling unit around the rotation axis positioned in the vicinity of the stapling portion, since the one of the first stoppers positioned in the rotation direction rotates together with the stapling means, it is possible to prevent the first stopper from disturbing the rotation of the stapling means as well as to maintain an accurate positional relationship between the stapling means and the first stopper.

Also, the pair of second stoppers are provided outward of the first stoppers, and proper combinations of the first and second stoppers make it possible to perform stapling with respect to stacks of sheets of paper of two or more sizes with enhanced accuracy in stapling positions. Also, since each of the second stoppers moves between the first position and the second position independently of each other with the movement of the stapling unit, there is no need to separately prepare drive means for moving the second stoppers, and this helps make the structure of the paper post processing apparatus even simpler. For example, providing elastically biasing means for biasing the second stoppers to the first position makes it possible to move the second stoppers with a simple mechanism.

Also, when the second stoppers are positioned in the second position, by making them retract from the edge of a stack of sheets of paper, interference between the second stoppers and the edge of the stack of sheets of paper is prevented, and this permits the second stoppers to move smoothly. Furthermore, the alignment of a stack of sheets of paper can thus be maintained, and hence a paper post processing apparatus that is capable of accurately performing stapling with respect to a neatly-aligned stack of sheets of paper can be realized.

What is claimed is:

1. A paper post processing apparatus, comprising:

a processing tray that accommodates a plurality of sheets of paper;

stapling means that performs edge stapling with respect to a paper stack on the processing tray;

a stapling unit on which the stapling means is mounted and that moves in a direction perpendicular to a paper transport direction; and a pair of first stoppers that are fixed one at each side of the stapling means on the stapling unit and that jog and thereby align a paper-transport-direction edge of paper, wherein the stapling means is supported on the stapling unit so as to be rotatable around a rotation axis positioned in a vicinity of the stapling portion, and only one of the first stoppers that is positioned outside with respect to a direction in which the stapling means rotates is designed to rotate together with the stapling means.

2. The paper post processing apparatus of claim 1, wherein, the first stoppers are, when stapling is performed at two positions in an edge part of a paper stack, positioned inward of a minimum-size paper width.

3. The paper post processing apparatus of claim 2, wherein, outward of the first stoppers, there is provided a pair of second stoppers that move, independently of each other by the movement of the stapling unit, between a first position where the second stoppers can align a paper-transport-direction edge of minimum-size paper and a second position that is located outward of a maximum-size paper width.

4. The paper post processing apparatus of claim 3, wherein, the second stoppers, when moving to the second position, retract to a downstream side in the paper transport direction with respect to an edge of a paper stack.

5. The paper post processing apparatus of claim 3, wherein, elastically biasing means that elastically biases the second stopper and thereby keeps the second stopper in the first position is provided.

6. The paper post processing apparatus of claim 5, wherein, the second stoppers, when moving to the second position, retract to a downstream side in the paper transport direction with respect to an edge of a paper stack.

7. The paper post processing apparatus of claim 1, wherein, outward of the first stoppers, there is provided a pair of second stoppers that move, independently of each other by a movement of the stapling unit, between a first position where the second stoppers can align a paper-transport-direction edge of minimum-size paper and a second position that is located outward of a maximum-size paper width.

8. The paper post processing apparatus of claim 7, wherein, the second stoppers, when moving to the second position, retract to a downstream side in the paper transport direction with respect to an edge of a paper stack.

9. The paper post processing apparatus of claim 8, wherein at an end of each of the second stoppers, a paper receiving portion is formed for aligning an edge of a paper stack, the second stoppers are supported so as to be slidable in a direction perpendicular to a paper transport direction along a guide axis fixed to a frame inside a main body of the apparatus and are also supported so as to be swingable around the guide axis with respect to an edge of a paper stack, and on the frame is formed a groove to which another end of each of the second stoppers is slidably engaged and that, with movement of the second stoppers from the first position to the second position, permits the paper receiving portions to retract to the downstream side in the paper transport direction with respect to an edge of a paper stack.

10. The paper post processing apparatus of claim 7, wherein, elastically biasing means that elastically biases the second stopper and thereby keeps the second stopper in the first position is provided.

11. The paper post processing apparatus of claim 10, wherein, the second stoppers, when moving to the second position, retract to a downstream side in the paper transport direction with respect to an edge of a paper stack.

12. The paper post processing apparatus of claim 11, wherein at an end of each of the second stoppers, a paper receiving portion is formed for aligning an edge of a paper stack, the second stoppers are supported so as to be slidable in a direction perpendicular to a paper transport direction along a guide axis fixed to a frame inside a main body of the apparatus and are also supported so as to be swingable around the guide axis with respect to an edge of a paper stack, and on the frame is formed a groove to which another end of each of the second stoppers is slidably engaged and that, with movement of the second stoppers from the first position to the second position, permits the paper receiving portions to retract to the downstream side in the paper transport direction with respect to an edge of a paper stack.

13. A paper post processing apparatus, comprising:

a processing tray that accommodates a plurality of sheets of paper;

stapling means that performs edge stapling with respect to a paper stack on the processing tray;

a stapling unit on which the stapling means is mounted and that moves in a direction perpendicular to a paper transport direction; and a pair of first stoppers that are fixed one at each side of the stapling means on the stapling unit and that jog and thereby align a paper-transport-direction edge of paper, wherein, outward of the first stoppers, there is provided a pair of second stoppers that move, independently of each other, between a first position where the second stoppers can align an edge of minimum-size paper and a second position that is located outward of a maximum-size paper width, wherein, the second stoppers, when moving to the second position, retract to a downstream side in the paper transport direction with respect to an edge of a paper stack, and wherein at an end of each of the second stoppers, a paper receiving portion is formed for aligning an edge of a paper stack, the second stoppers are supported so as to be slidable in a direction perpendicular to a paper transport direction along a guide axis fixed to a frame inside a main body of the apparatus and are also supported so as to be swingable around the guide axis with respect to an edge of a paper stack, and on the frame is formed a groove to which another end of each of the second stoppers is slidably engaged and that, with movement of the second stoppers from the first position to the second position, permits the paper receiving portions to retract to the downstream side in the paper transport direction with respect to an edge of a paper stack.

14. A paper post processing apparatus, comprising:

a processing tray that accommodates a plurality of sheets of paper;

stapling means that performs edge stapling with respect to a paper stack on the processing tray;

a stapling unit on which the stapling means is mounted and that moves in a direction perpendicular to a paper transport direction; and a pair of first stoppers that are fixed one at each side of the stapling means on the stapling unit and that jog and thereby align a paper-transport-direction edge of paper, wherein, outward of the first stoppers, there is provided a pair of second stoppers that move, independently of each other, between a first position where the second stoppers can align an edge of minimum-size paper and a second position that is located outward of a maximum-size paper width, wherein, elastically biasing means that elastically biases the second stopper and thereby keeps the second stopper in the first position is provided, wherein, the second stoppers, when moving to the second position, retract in a direction perpendicular to an edge of a paper stack, and wherein at an end of each of the second stoppers, a paper receiving portion is formed for aligning an edge of a paper stack, the second stoppers are supported so as to be slidable in a direction perpendicular to a paper transport direction along a guide axis fixed to a frame inside a main body of the apparatus and are also supported so as to be swingable around the guide axis with respect to an edge of a paper stack, and on the frame is formed a groove to which another end of each of the second stoppers is slidably engaged and that, with movement of the second stoppers from the first position to the second position, permits the paper receiving portions to retract to the downstream side in the paper transport direction with respect to an edge of a paper stack.

* * * * *